US007883283B2

(12) United States Patent
Oshida et al.

(10) Patent No.: US 7,883,283 B2
(45) Date of Patent: Feb. 8, 2011

(54) PRINTER EQUIPPED WITH CUTTER MECHANISM

(75) Inventors: Kazuya Oshida, Nagano (JP); Takeshi Komaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/477,621

(22) Filed: Jun. 3, 2009

(65) Prior Publication Data

US 2009/0238631 A1 Sep. 24, 2009

Related U.S. Application Data

(62) Division of application No. 10/986,469, filed on Nov. 12, 2004, now abandoned.

(30) Foreign Application Priority Data

Nov. 14, 2003 (JP) ..... P2003-385406
Apr. 1, 2004 (JP) ..... P2004-109212

(51) Int. Cl.
*B41J 11/66* (2006.01)

(52) U.S. Cl. ..... 400/621; 400/693; 346/24; 83/564

(58) Field of Classification Search ..... 400/621
See application file for complete search history.

(56) References Cited

U.S. PATENT DOCUMENTS 3,082,970 A 3/1963 Rasmussen
4,614,949 A 9/1986 Hakkaku et al.
4,907,014 A * 3/1990 Tzeng et al. ..... 346/24
5,139,354 A 8/1992 Saeki
5,377,569 A * 1/1995 Richards et al. ..... 83/98
5,651,624 A 7/1997 Passer
5,820,068 A 10/1998 Hosomi et al.
5,833,380 A 11/1998 Hosomi et al.
5,884,861 A 3/1999 Hosomi et al.
6,118,469 A 9/2000 Hosomi
6,361,231 B1 3/2002 Sato et al.
6,443,645 B1 9/2002 Takei et al.

(Continued)

FOREIGN PATENT DOCUMENTS

EP 1 156 002 11/2001

(Continued)

*Primary Examiner*—Jill E Culler
(74) *Attorney, Agent, or Firm*—Nixon & Vanderhye P.C.

(57) ABSTRACT

A rolled sheet is accommodated in an accommodating section. A cover is movable between an open position for opening the accommodating section and a closed position for covering the accommodating section. A part of the rolled sheet fed from the accommodating section is transported through the transporting path. A print head is disposed in a first side relative to the transporting path and operable to perform printing on the part of the rolled sheet in the transporting path. A cutter is disposed in the first side and movable between an operable position at which the cutter is operable to cut the part of the rolled sheet and a covered position at which the cutter is not operable to cut the part of the rolled sheet. The cutter is moved to the operable position when the cover is moved from the open position to the closed position, and is moved to the covered position when the cover is moved from the closed position to the open position. A cutter cover covers the cutter in the covered position.

10 Claims, 14 Drawing Sheets

U.S. PATENT DOCUMENTS

| | | | | |
|---|---|---|---|---|
| 6,474,883 | B1 | 11/2002 | Kawakami et al. | |
| 6,508,600 | B1 * | 1/2003 | Nonaka | 400/621 |
| 6,749,352 | B2 | 6/2004 | Yamada et al. | |
| 6,789,969 | B2 | 9/2004 | Hirabayashi et al. | |
| 2002/0006302 | A1 | 1/2002 | Yamada et al. | |
| 2002/0056354 | A1 | 5/2002 | Morita et al. | |

FOREIGN PATENT DOCUMENTS

| | | |
|---|---|---|
| JP | 2-78352 | 6/1990 |
| JP | 9-141595 | 6/1997 |
| JP | 2000-052291 | 2/2000 |
| JP | 2000-061881 | 2/2000 |
| JP | 2000-167799 | 6/2000 |
| JP | 2001-146358 | 5/2001 |
| JP | 2001-205896 | 7/2001 |
| JP | 2001-341369 | 12/2001 |
| JP | 2002-128328 | 5/2002 |
| JP | 2003-1885 | 1/2003 |
| JP | 2003-118185 | 4/2003 |

* cited by examiner

PRINTER EQUIPPED WITH CUTTER MECHANISM

CROSS-REFERENCES TO RELATED APPLICATIONS

This application is a divisional of U.S. patent application Ser. No. 10/986,469, filed Nov. 12, 2004, now abandoned, which claims priority of Japanese Patent Application No. 2003-385406, filed Nov. 14, 2003, and Japanese Patent Application No. 2004-109212, filed Apr. 1, 2004, the entire contents of each of which are hereby incorporated by reference in this application.

BACKGROUND OF THE INVENTION

The present invention relates to a printer capable of performing printing with respect to a rolled recording sheet and equipped with a cutter mechanism for cutting the rolled recording sheet.

A printer capable of accommodating a rolled recording sheet therein has been known, performing printing on the recording sheet with a print head while feeding the recording sheet with a feeding roller. When printing is finished, the recording sheet led out from a sheet outlet of the printer is cut with a cutter disposed at the sheet outlet.

The cutter may be a manual cutter configured such that a recording sheet is pressed against a stationary blade disposed at the sheet outlet. Alternatively, the cutter may be an automatic cutter that cuts the recording sheet by actuating a movable blade with a driving force from a motor or the like.

When the rolled recording sheet is replaced, a housing section needs to be released by opening a door cover. The cutter, either the manual cutter or the automatic cutter, can be provided at a position not to be exposed to the outside while the door cover remains closed. However, when the door cover is opened, the cutter may possibly be exposed to the outside, and the cutter may be impaired. In order to solve this problem, for example, Japanese Patent Publication No. 2001-205896A discloses a mechanism provided with a movable cutter cover, by which when the door cover is opened, the cutter cover is moved to a position to cover the cutter, and when the door cover is closed, the cutter cover that has been covering the cutter is retracted so as not to interfere with a cutting operation.

For the cutter to be covered by the cutter cover so as not to be exposed to the outside, the cutter cover needs to be sufficiently large with respect to the cutter, which makes the size of the cutter cover considerably large. Hence, for the method of moving the cutter cover disclosed in the above publication, a space for the cutter cover to move and a space to install a mechanism to move the cutter cover are needed around the cutter. These spaces are thought to be considerably large.

With a printer of a medium or large size in which spaces are allowed around the cutter, the above configuration is applicable and advantageous; however, in a printer of a small size or in a case where another device is installed near the printer, space around the cutter is limited, and the method is almost inapplicable.

SUMMARY OF THE INVENTION

It is therefore an object of the invention to provide a mechanism that is able to achieve a state in which the cutter will not be exposed to the outside when the door cover is opened even when a space around the cutter is limited, as well as a printer equipped with this mechanism.

In order to achieve the above object, according to the invention, there is provided a printer, comprising:

an accommodating section accommodating a rolled sheet;

a cover movable between an open position for opening the accommodating section and a closed position for covering the accommodating section;

a transporting path through which a part of the rolled sheet fed from the accommodating section is transported;

a print head disposed in a first side relative to the transporting path, and operable to perform printing on the part of the rolled sheet in the transporting path;

a cutter disposed in the first side, and movable between an operable position at which the cutter is operable to cut the part of the rolled sheet and a covered position at which the cutter is not operable to cut the part of the rolled sheet, the cutter being moved to the operable position when the cover is moved from the open position to the closed position, and being moved to the covered position when the cover is moved from the closed position to the open position; and a cutter cover which covers the cutter in the covered position.

With this configuration, the cutter is not exposed to the outside even if space around the cutter is limited because the cutter is moved in accordance with the movement of the cover.

Preferably, the cutter is bent corresponding to an inner face of the cutter cover.

In this case, the angle of the cutter can be adjusted to optimize the cutting ability for the rolled sheet. Further, the cutter can be housed in the narrow space defined by the cutter cover.

According to the invention, there is also provided a printer, comprising:

an accommodating section accommodating a rolled sheet;

a cover movable between an open position for opening the accommodating section and a closed position for covering the accommodating section;

a transporting path through which a part of the rolled sheet fed from the accommodating section is transported; a print head disposed in a first side relative to the transporting path, and operable to perform printing on the part of the rolled sheet in the transporting path;

a cutter disposed in the first side, and movable between an operable position at which the cutter is operable to cut the part of the rolled sheet and a covered position at which the cutter is not operable to cut the part of the rolled sheet, the cutter being moved to the operable position when the cover is moved from the open position to the closed position, and being moved to the covered position when the cover is moved from the closed position to the open position; and a cutter cover having a face onto which a cutting edge of the cutter is brought into contact when the cutter is in the covered position.

With this configuration, the cutting edge of the cutter is not directly exposed to the outside even if the space around the cutter is limited.

Preferably, the cutter is bent such that at least the cutting edge is brought into contact with the face of the cutter cover.

In this case, the angle of the cutter can be adjusted to optimize the cutting ability for the rolled sheet. Further, the cutter can be placed in the narrow space defined by the cutter cover.

In the above configurations, it is preferable that the cutter is supported by a pivotable arm member, and the arm member is pivotably supported on a frame.

The cutter can thus be moved with a simple structure using less space.

It is further preferable that an elastic member urges the arm member so as to move the cutter from the operable position to the covered position when the cover is moved from the closed position to the open position. Here, the cover is brought into contact with the arm member to pivot the arm member so that the cutter is moved from the covered position to the operable position against an urging force of the elastic member when the cover is moved from the open position to the closed position.

In this case, since the movement of the cutter is effected by the direct contact between the cover and the arm member, the desired operation can be attained with reduced manufacturing costs.

In the above configurations, it is preferable that the cover is pivotable between the open position and the closed position.

It is also preferable that a platen member having a platen face is provided on the cover so as to be movable between a facing position and retracted position. The platen member is moved to the facing position at which the platen face is opposed to the print head when the cover is moved from the open position to the closed position, and is moved to the retracted position when the cover is moved from the closed position to the open position.

This configuration advantageously saves space around the print head, especially when the platen member is provided on the tip end portion of the pivotable cover.

It is preferable that the printer further comprises:

a first roller provided on the cover and operable to feed the part of the rolled sheet when the cover is placed in the closed position;

a second roller disposed so as to oppose to the first roller when the cover is placed in the closed position; and an elastic member urging the second roller against the first roller to nip the part of the rolled sheet therebetween and to retain the cover in the closed position.

In this case, it is not necessary to provide an individual locking mechanism for the cover because the second roller also serves as a locking member.

Preferably, a first roller is operable to transport the part of the rolled sheet in the transporting path and a second roller is operable to press the part of the rolled sheet against the first roller. Here, the cover supports one of the first roller and the second roller, so that the first roller and the second roller are brought into contact with each other when the cover is moved to the closed position, and are separated from each other when the cover is moved to the open position. The cutter moves from the covered position to the operable position after the first roller and the second roller are brought into contact with each other when the cover is moved from the open position to the closed position. The cutter moves from the operable position to the covered position before the first roller and the second roller are separated from each other when the cover is moved from the closed position to the open position.

According to the invention, there is also provided a printer, comprising:

an accommodating section;

a cover movable between an open position for opening the accommodating section and a closed position for covering the accommodating section;

a print platen coupled to the cover; and a cutter arm supporting a cutter attached to the accommodating section and pivotable between an operable position and a covered position, wherein the platen comprises urging structure that engages the cutter arm in the closed position to pivot the cutter arm from the covered position to the operable position.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1:
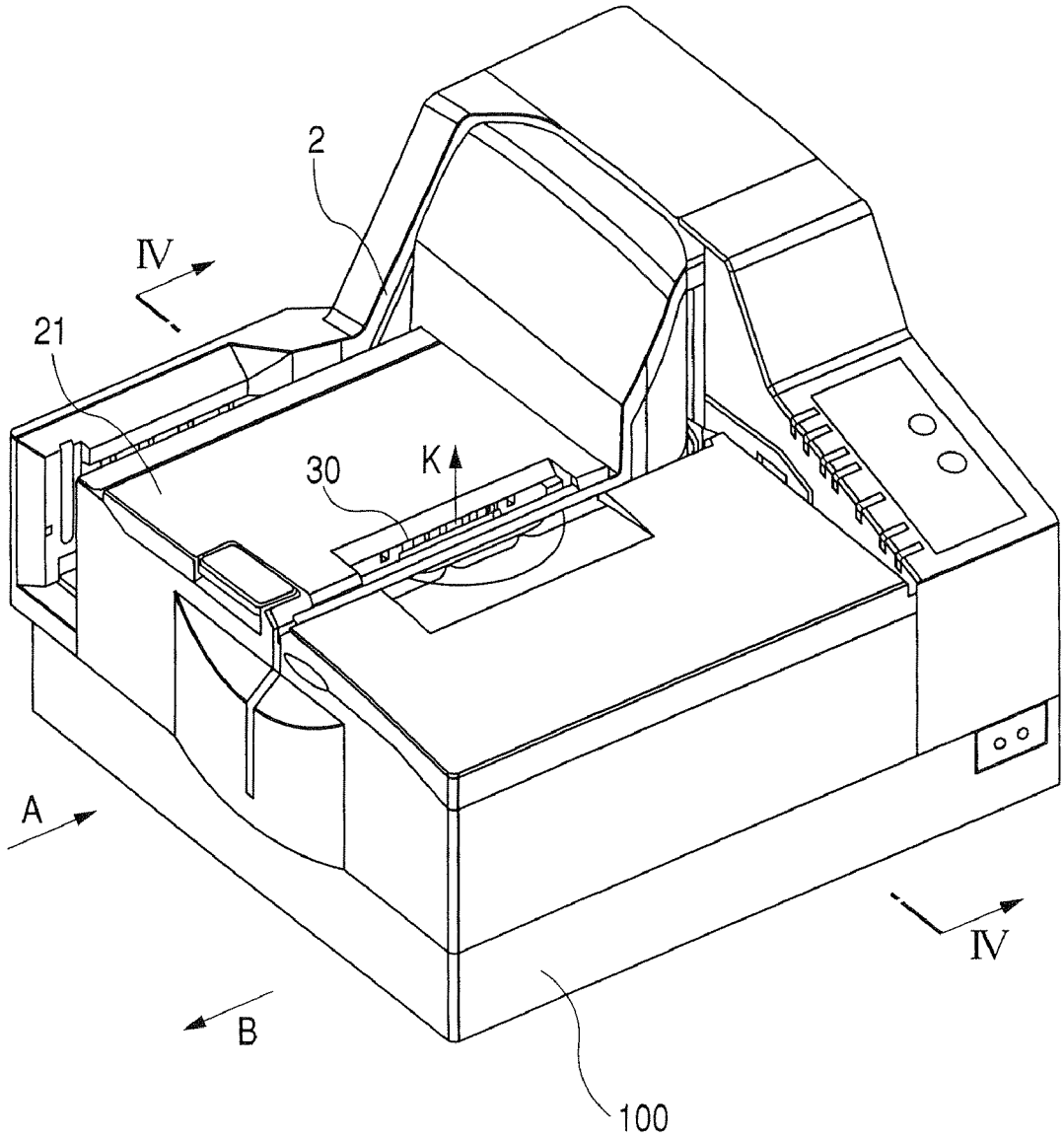
FIG. 1 is a perspective view of a printer according to a first embodiment, showing a closed door cover.

Embodiments of the invention will be described below in detail with reference to the accompanying drawings.

As shown in FIGS. 1 to 4, a printer 100 according to a first embodiment of the invention is provided with a first print mechanism 1 to read or print an image while transporting a cut sheet 3 through a U-shaped transportation path, and a second print mechanism 5, having a transportation path orthogonally intersecting with the U-shaped transportation path, to perform printing on a rolled recording sheet 20.

In the first print mechanism 1, a cut sheet 3 is inserted into the U-shaped transportation path 2 in a direction indicated by arrow A, an image or information pre-printed in magnetic ink on the cut sheet 3 is read by a scanner or an MICR (Magnetic Ink Character Reader) while the cut sheet 3 is being transported through the transportation path 2; printing is performed on the cut sheet 3 by a print head 14; and the cut sheet 3 is ejected in a direction indicated by arrow B. In the second print mechanism 5, printing is performed by the same print head 14 while transporting a recording sheet 20*a*, which is pulled from a rolled recording sheet 20 accommodated in an accommodating section 22 covered with a door cover 21, in a direction almost orthogonal to the transportation path 2; and the recording sheet 20*a* is ejected from a sheet outlet 30 in a direction indicated by arrow K.

Figure 2:
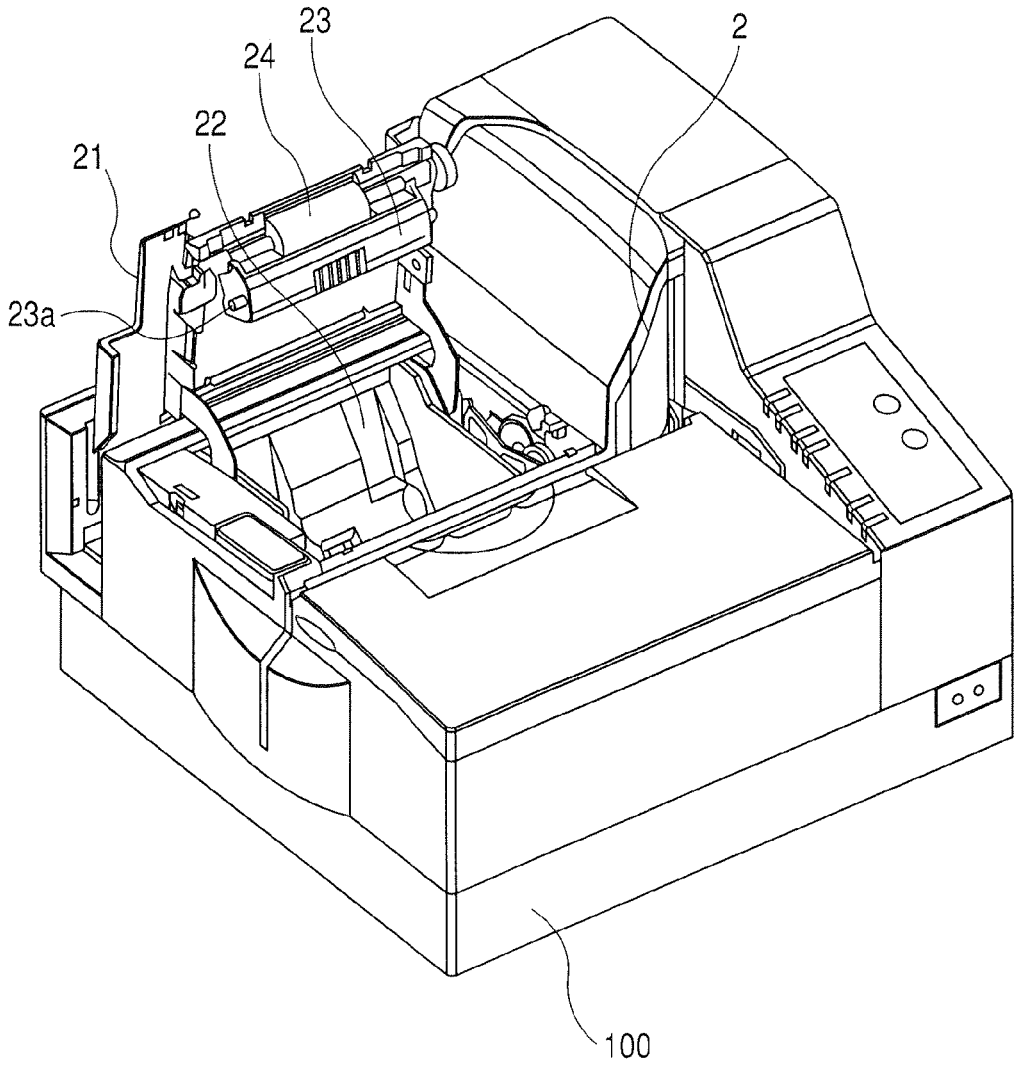
FIG. 2 is a perspective view of the printer of FIG. 1, showing an open door cover.

FIG. 2 shows a state when the door cover 21 used to cover the accommodating section 22 is opened. Because a platen 23 and a paper feeding roller 24 are attached to the door cover 21, the transportation path is released when the door cover 21 is opened, which makes it easy to replace a rolled recording sheet. This will be described in detail later.

The first print mechanism 1 will now be described in detail with reference to FIG. 3.

The U-shaped transportation path 2 comprises an outer transportation wall 2*a*, an inner transportation wall 2*b*, and a path 2*c* defined in between. A cut sheet 3 is guided by the transportation walls 2*a* and 2*b* on the both sides to be transported through the path 2*c*. The U-shaped transportation path 2 comprises, along the transportation direction of the cut sheet 3, an entrance linear section 4*a*, a first curved section 4*b*, an intermediate linear section 4*c*, a second curved section 4*d*, and an exit linear section 4*e*.

The transportation path 2 is provided with a first transportation roller 6 and a second transportation roller 7 to feed the cut sheet 3, and an ejection roller 8. The respective rollers are provided with driving rollers 6*a*, 7*a*, and 8*a* to which a driving force from a driving motor (not shown) is transmitted, and pressing rollers 6*b*, 7*b*, and 8*b* to press the cut sheet 3 against the driving rollers 6*a*, 7*a*, and 8*a*. The pressing rollers 6*b*, 7*b*, and 8*b* press the cut sheet 3 against the driving rollers 6*a*, 7*a*, and 8*b* with a force generated by an elastic member such as a spring.

In the intermediate linear section 4*c*, a scanner 11 and a scanner 12 read images on both faces of the cut sheet 3. An MICR 13 to read information pre-printed on the cut sheet 3 with magnetic ink is provided next to the scanner 12.

A print head 14 that performs printing on the cut sheet 3 is disposed in the exit linear section 4*e*. In the first embodiment, the print head 14 of an ink jet type is used as the print head; however, various types of print heads including a wire dot head are applicable. The print head 14 is mounted on a carriage 15, and is thereby able to move in a direction parallel to the exit linear section 4*e*. By driving the carriage 15, the print head 14 is allowed to scan over the cut sheet 3 placed at a print position 18, which enables printing on the cut sheet 3 to be performed. Also, by driving the carriage 15, the print head 14 is allowed to move from the print position 18 to a stand-by position 19. In addition, a paper guide 27*a* (see FIG. 4) to guide the cut sheet 3 is provided in the vicinity of the print position 18.

The cut sheet 3, when inserted in the entrance linear section 4*a* in a direction indicated by an arrow A, is pinched by the first transportation roller 6 first to be fed to the intermediate linear section 4*c* via the first curved section 4*b*, and passes by the scanner 11. In this instance, an image on one face of the cut sheet 3 is read. When the cut sheet 3 passes by the scanner 12 next, an image on the other face of the cut sheet 3 is read. Information written in magnetic ink is read when the cut sheet 3 further passes by the MICR 13.

While the cut sheet 3 is being fed by the first transportation roller 6, the leading edge is pinched by the second transportation roller 7 for the cut sheet 3 to be fed further to the exit linear section 4*e* via the second curved section 4*d*. Printing is performed on the cut sheet 3 when the cut sheet 3 passes by the print head 14.

While the cut sheet 3 is being fed by the second transportation roller 7, the leading edge is pinched by the discharge roller 8 for the cut sheet 3 to be fed further and ejected from the exit linear section 4*e* in a direction indicated by an arrow B. The cut sheet 3 may be suspended at the print position 18 for the printing to take place by scanning the print head 14.

As has been described, printing on the cut sheet 3 is performed as image data, and data written in magnetic ink are read by the first print mechanism 1.

Figure 3:
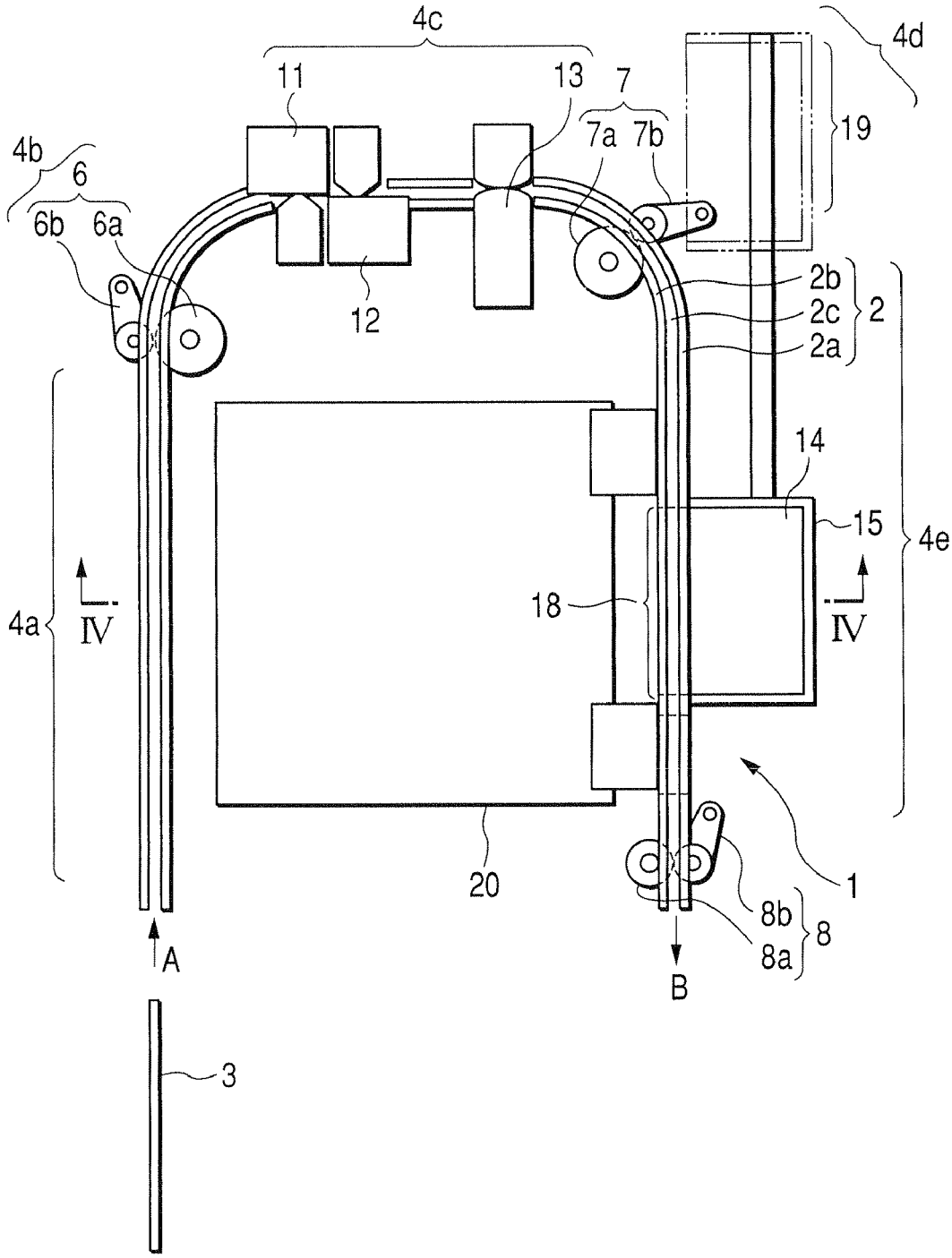
FIG. 3 is a schematic plan view of a first print mechanism in the printer of FIG. 1.
Figure 4:
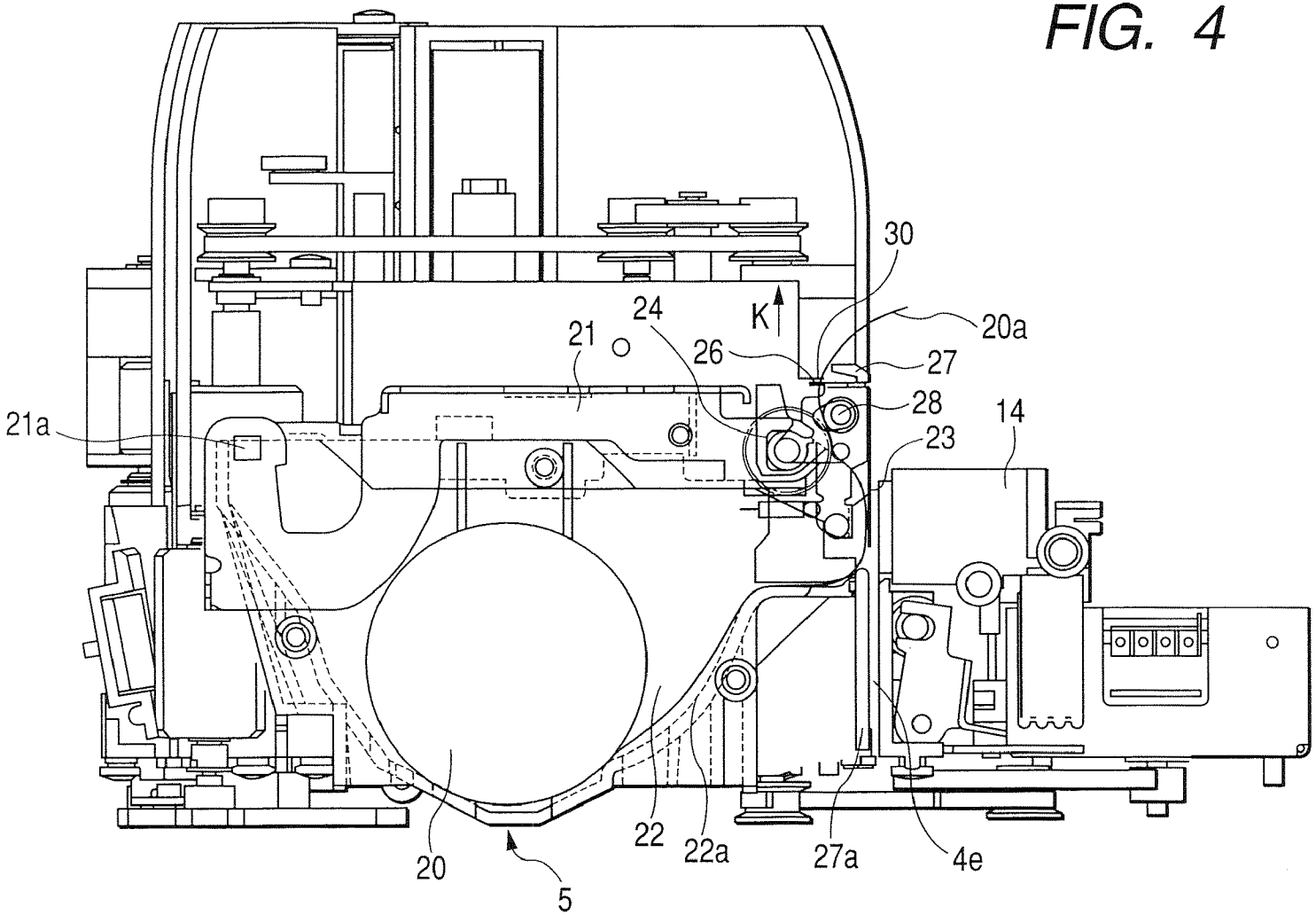
FIG. 4 is a section view taken along the line IV-IV in FIGS. 1 and 3.

As is shown in FIGS. 3 and 4, the second print mechanism 5 performs printing on a recording sheet 20*a* pulled from rolled recording sheet 20 by the print head 14, which is also used by the first print mechanism 1. The transportation direction of the recording sheet 20*a* orthogonally intersects with the transportation path 2.

The second print mechanism 5 will be described in detail with reference to FIG. 4. This figure shows a state in which the door cover 21 is closed and the recording sheet 20*a* pulled from the rolled recording sheet 20 is set in the second print mechanism 5, that is, a printing-enabled state.

The accommodating section 22, which is covered by the door cover 21 from above, accommodates the rolled recording sheet 20. As is shown in FIG. 3, the accommodating section 22 is placed between the entrance linear section 4*a* and the exit linear section 4*e* of the first print mechanism 1. Also, the door cover 21 is opened or closed as it pivots about a pivot center 21*a*.

The recording sheet 20*a* pulled from the rolled recording sheet 20 passes through a space between the print head 14 and the platen 23 along a transportation path 22*a*, and further passes through a space between the paper feeding roller 24 and a pressing roller 28, so that the leading edge comes outside of the printer 100 from the sheet outlet 30. The sheet outlet 30 is provided with a cutter 26 used to manually cut the recording sheet 20*a*. The cutter 26 is provided at a position so as not to be exposed to the outside through the sheet outlet 30 while the door cover 21 remains closed.

When a print command is received via a controller (not shown) of the printer 100, the driving motor (not shown) starts to rotate, and a driving force thus generated is transmitted to cause the paper feeding roller 24 to rotate. The pressing roller 28 is pushed toward the paper feeding roller 24 by a spring 43 (see FIG. 15) described later, and thereby presses the recording sheet 20*a* pinched between the pressing roller 28 and the paper feeding roller 24 against the paper feeding roller 24. According to the configuration described above, the recording sheet 20*a* pinched between the paper feeding roller 24 and the pressing roller 28 is fed upward.

When this paper feeding takes place, the rolled recording sheet 20 rotates and the recording sheet 20*a* is pulled continuously to be transported toward the print head 14 through the transportation path 22*a*. Printing is then performed at the print position 18 between the print head 14 and the platen 23. Subsequently, the printed recording sheet 20*a* is fed further upward to pass by a position to be pinched between the paper feeding roller 24 and the pressing roller 28, and is ejected outside of the printer 100 from the sheet outlet 30. The paper feeding stops after the predetermined printing ends and the last printed portion is ejected outside of the printer 100. The printed recording sheet 20*a* is cut and taken out by manually pressing the ejected recording sheet 20*a* against the cutter 26.

Figure 5:
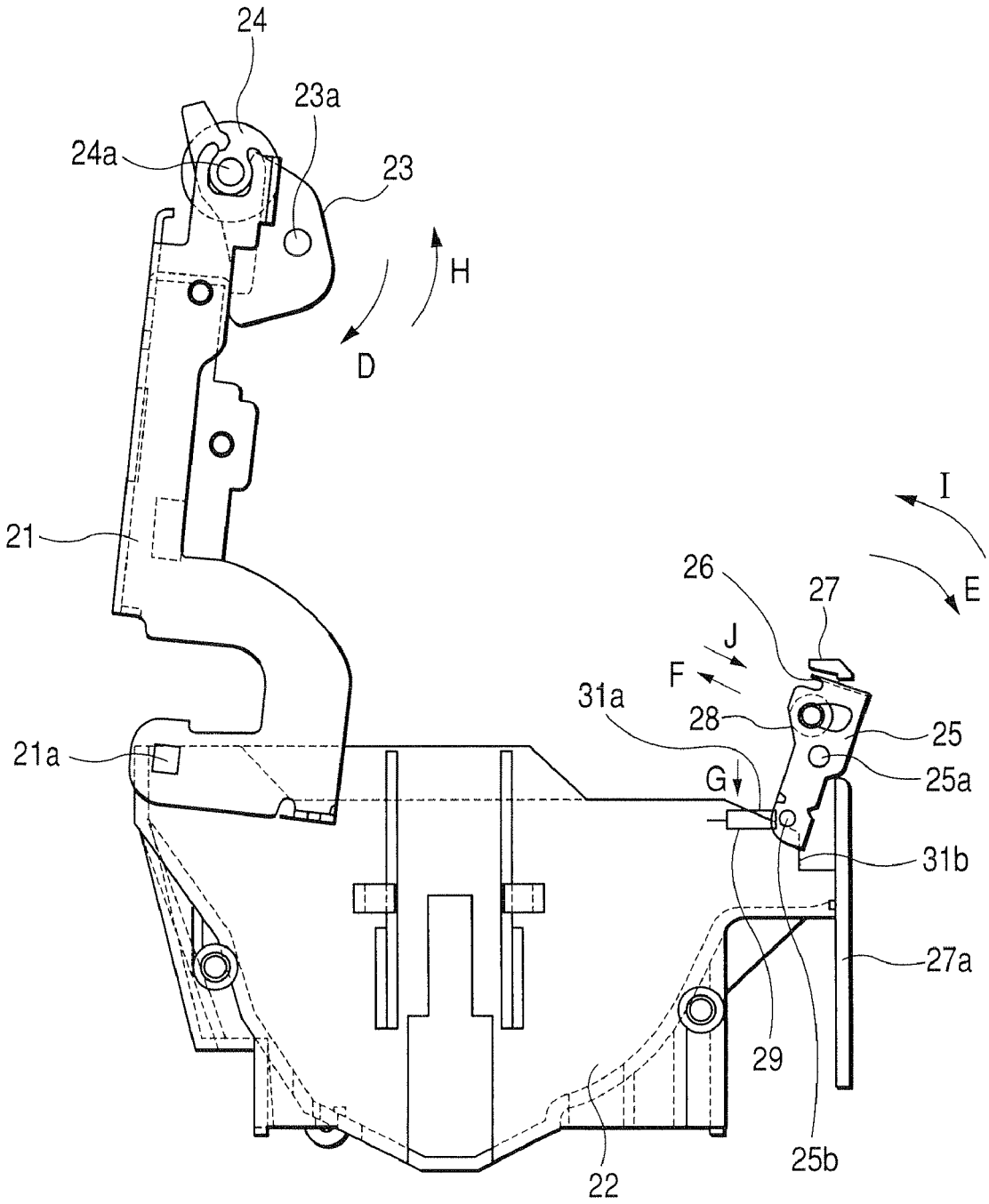
FIG. 5 is a section view of a second print mechanism in the printer of FIG. 1, showing the door cover fully opened.

A manner by which the door cover 21 is opened to replace and set the rolled recording sheet 20 will now be described. FIG. 5 shows a state in which the door cover 21 is fully opened. As is shown in this figure, the platen 23 and the paper feeding roller 24 are attached to the door cover 21.

The rolled recording sheet 20 is removed and a new rolled recording sheet 20 is loaded in the accommodating section 22. The recording sheet 20*a* is pulled for the leading edge to come outside of the printer 100 along the transportation path 22*a* by passing the front of the print head 14 and then the fronts of the pressing roller 28 and the cutter 26. When the door cover 21 is closed, the transportation path is also closed, and the recording sheet 20*a* is set in a space between the print head 14 and the platen 23. A printing-enabled state, in which the recording sheet 20*a* is pinched between the paper feeding roller 24 and the pressing roller 28, is thus established.

As is shown in FIG. 4, the cutter 26 is provided at a position not to be exposed to the outside while the door cover 21 remains closed. However, when the door cover 21 is opened while the cutter 26 remains at that position, the cutter 26 is exposed to the outside. To avoid this inconvenience, the second print mechanism 5 in the first embodiment is provided with the cutter storing mechanism that covers the cutter 26.

The cutter storing mechanism and the closing mechanism of the door cover 21 provided with this cutter storing mechanism will now be described in detail.

In the first embodiment, besides the cutter storing mechanism, a movable platen is attached to the door cover 21. This configuration can save space when the door cover 21 is opened or closed. This combination of the mechanisms allows the second print mechanism 5 to be accommodated in an extremely limited space in the U-shaped transportation path 2 of the first print mechanism 1.

Figure 6:
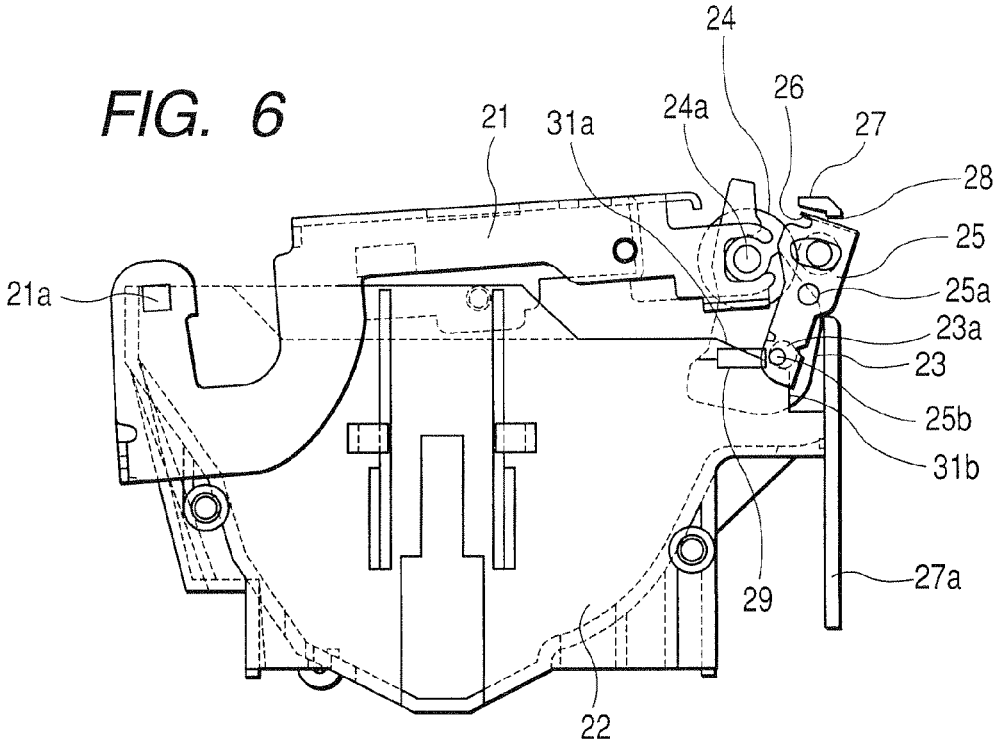
FIG. 6 is a section view of the second print mechanism in the printer of FIG. 1, showing the door cover operated to be closed.
Figure 7:
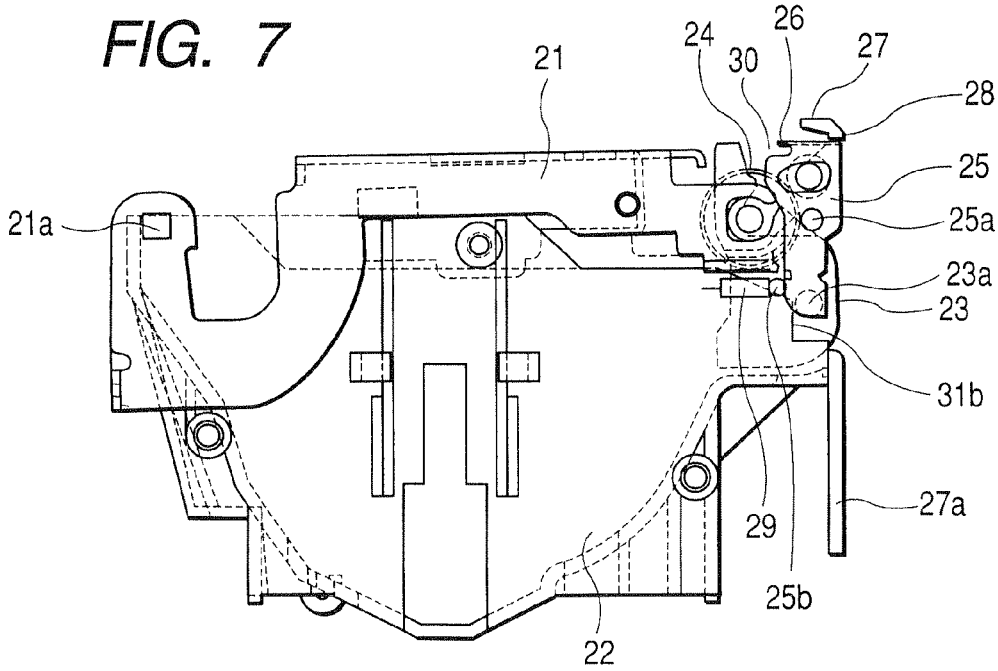
FIG. 7 is a section view of the second print mechanism in the printer of FIG. 1, showing the door cover fully closed.

FIGS. 5 to 7 show motions when the door cover 21 is shifted from the fully opened state to the fully closed state. FIG. 5 shows the door cover 21 fully opened. FIG. 6 shows the door cover 21 being closed. FIG. 7 shows the door cover 21 fully closed.

Respective members constituting the cutter storing mechanism and the closing mechanism will be described first with reference to FIG. 5.

The door cover 21 is pivoted about the pivot center 21*a*, and the paper feeding roller 24 is attached to the tip end of the door cover 21 in a rotatable manner via the rotational axis 24*a*. Also, the platen 23 is attached to the tip end of the door cover 21 in a pivotable manner via the same rotational axis 24*a*. The platen 23 is kept pushed in a direction indicated by arrow D by an unillustrated spring.

Bosses 23*a* are attached to both sides of the platen 23. The movable platen also includes sliding faces 31*a* and 31*b* provided in the main body of the second print mechanism 5 (described later).

In a printing-enabled state in which the door cover 21 is closed, it is necessary for the platen 23 to be placed almost perpendicular with respect to the door cover 21 at a position opposing the print head 14 in close proximity. When the door cover 21 is opened while the platen 23 is kept in the almost perpendicular state, the maximum radius of rotation of the door cover 21 becomes larger. Hence, in order to prevent the platen 23 from interfering with the members on the printer main body, such as the pressing roller 28, while the door cover 21 is being opened or closed, the position of the pressing roller 28 or the like needs to be shifted to the right side in FIG. 5. A large space, therefore, needs to be secured around the cutter 26 and the print head 14.

In order to solve this problem, according to the movable platen of the first embodiment, the platen 23 is held in a folded state on the door cover 21 while the door cover 21 is being opened or closed. Hence, the maximum radius of rotation of the door cover 21 and platen 23 while being opened or closed does not differ considerably from the radius of rotation of a door cover comprising a single body. This makes it unnecessary for the members on the printer main body to be shifted markedly, and thereby eliminates the need for a large space.

The cutter storing mechanism comprises the cutter 26, an arm 25 to which the cutter 26 is attached, a tension spring 29 to impart a pushing force on the arm 25, and a cutter cover 27. The cutter cover 27 and the paper guide 27*a* to guide the cut sheet 3 comprise an integrally molded resin article, and the arm 25, the cutter 26, and a bracket 25*b* described below comprise an integrally pressed metal article.

The arm 25 is attached to the main body of the second print mechanism 5 pivotally via a pivot center 25*a*. The cutter 26 is attached to the top end of the arm 25. At the bottom of the arm 25 is provided a bracket 25*b* to which the tension spring 29 is attached. The arm 25 is kept pushed in a direction indicated by an arrow E by a tensile force of the tension spring 29. The pushing force keeps the cutter 26 at the storing position at which the cutter 26 is covered by the cutter cover 27. Hence, when the door cover 21 is opened, the cutter 26 is not exposed to the outside.

The attachment structure of the arm 25 and the pressing roller 28 of the second print mechanism 5 will be described in detail below.

Motions of the respective members when the door cover 21 in the fully-opened state is closed will now be described with reference to FIGS. 5 to 9. While the door cover 21 in the fully-opened state as is shown in FIG. 5 is closed, the tip end of the door cover 21 comes in close proximity to the pressing roller 28. In the first embodiment, however, because the platen 23 is folded toward the inner face of the door cover 21, the door cover 21 can be closed without the risk of interference of the platen 23 and the pressing roller 28.

As the door cover 21 is closed continuously, the bosses 23*a* at both ends of the platen 23 come in contact with points on the slanted sliding face 31*a* of the main body of the second print mechanism 5 indicated by arrow G. As the door cover 21 is closed further, the bosses 23*a* start to move toward the print head 14 along the slanted sliding face 31*a*. In association with this movement, the platen 23 rotates in a direction indicated by arrow H against the pushing force of the spring 29. The platen 23 thus moves forward to the position at which the platen 23 opposes the print head 14 in close proximity.

The paper feeding roller 24 at the tip end of the door cover 21 then comes in contact with the pressing roller 28 attached to a roller arm 42 described below. This state is shown in FIGS. 6 and 8.

Figure 8:
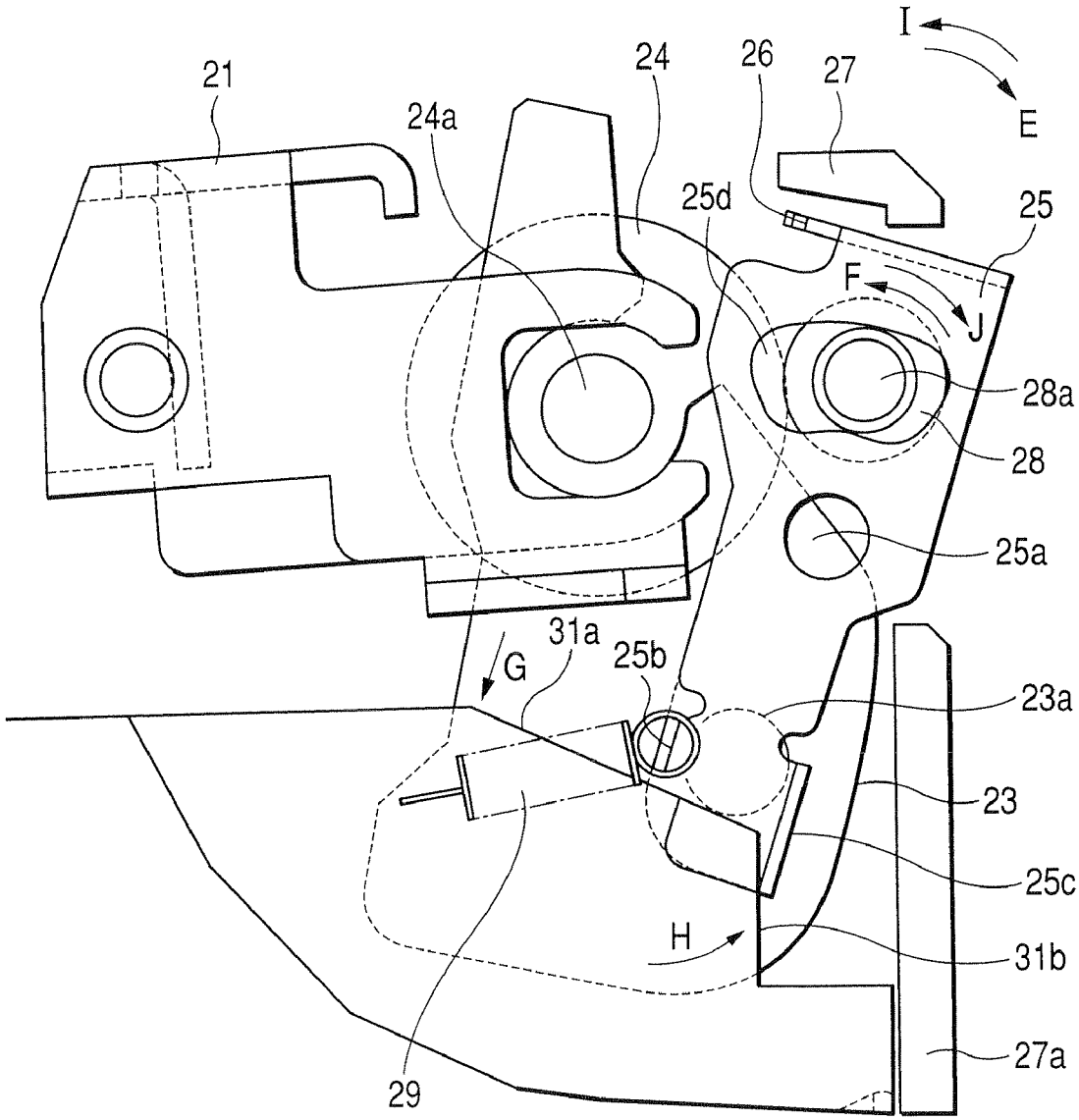
FIG. 8 is an enlarged side view of a tip end portion of the door cover of FIG. 6.

Referring to FIG. 8, a seat 25*c* provided at the bottom of the arm 25 abuts on the bosses 23*a* at both ends of the platen 23 almost as soon as the paper feeding roller 24 abuts on the pressing roller 28.

As the door cover 21 is closed further from the state shown in FIG. 8, the paper feeding roller 24 pushes the pressing roller 28 in a direction indicated by arrow J against a pressing force of the spring 43 (see FIG. 15) that keeps pushing the pressing roller 28. In association with this pushing, the roller arm 42 (see FIG. 15) starts to turn, which causes the pressing arm 28 to move in the direction of arrow J. A fan-shaped hole 25*d* is formed in each arm 25 to prevent the end portions of the roller shaft 28*a* supported by the roller arm 42 from interfering with the arm 25.

At the same time, because the seat 25*c* at the bottom of the arm 25 is pressed by the bosses 23*a*, the arm 25 starts to pivot about the pivot center 25*a* in a direction indicated by arrow I, and the cutter 26 thereby moves to the cutting position from the storing position at which the cutter 26 is covered by the cutter cover 27. Also, the bosses 23*a* move onto the vertical sliding face 31*b* from the slanted sliding face 31*a*. The door cover 21 is shown fully closed in FIGS. 7 and 9.

Figure 9:
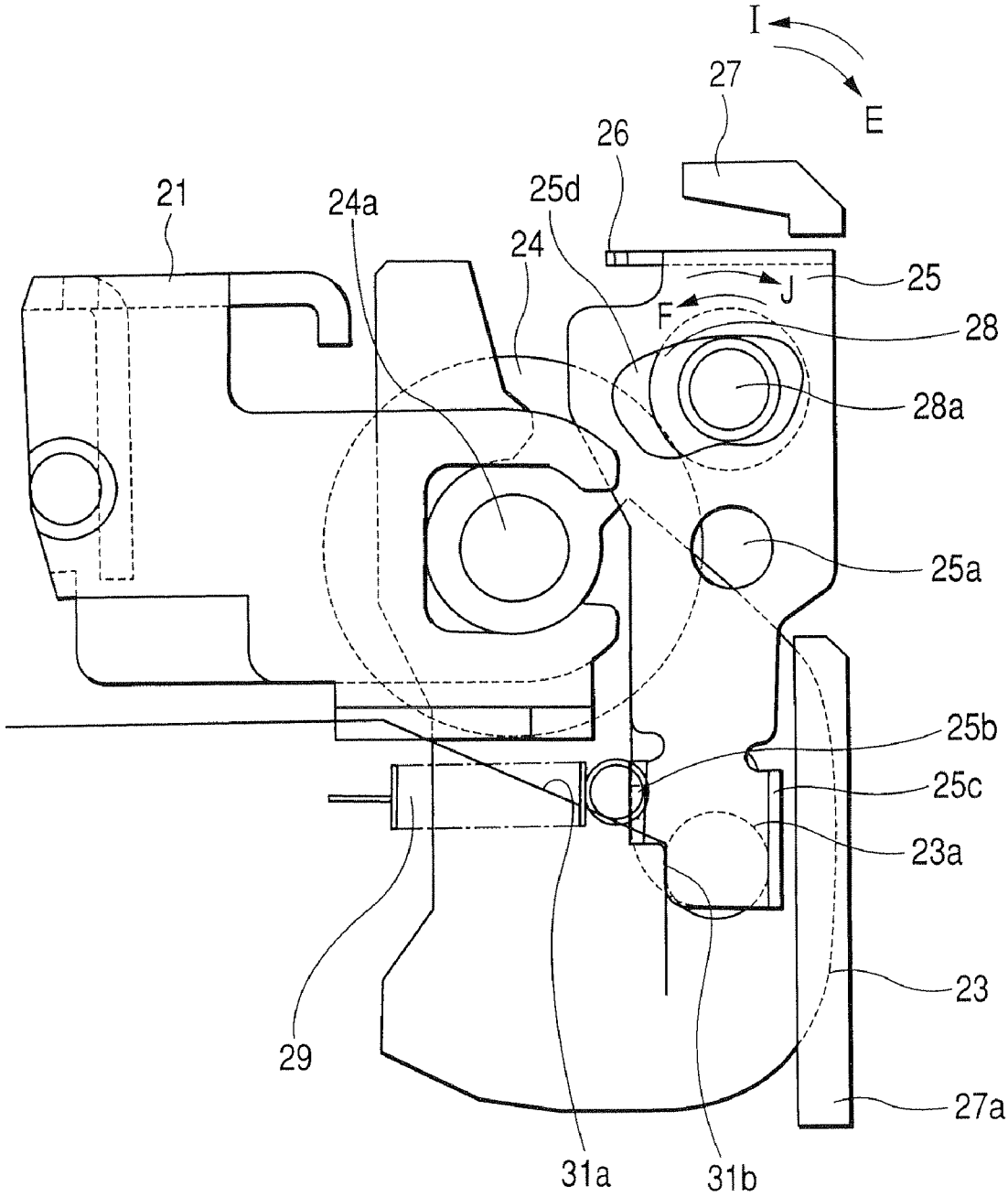
FIG. 9 is an enlarged side view of a tip end portion of the door cover of FIG. 7.

As is shown in FIG. 9, because the bosses 23*a* and the vertical sliding face 31*b* engage each other, the platen 23 is set to be almost perpendicular to the door cover 21 at a position at which the platen 23 opposes the print head 14 in close proximity. Also, the seat 25*c* is pressed by the bosses 23*a*, which causes the arm 25 to pivot to an almost vertical position. The cutter 26 is thus set at the cutting position at the sheet outlet 30. Also, a gear (not shown) attached to the paper feeding roller 24 engages a train of gears (not shown) in the printer main body to transmit a driving force of the driving motor.

Also, as is obvious from FIG. 9, because the paper feeding roller 24 provided at the tip end of the door cover 21 is pressed from diagonally above by a pressing force of the spring 43 (FIG. 15) that keeps pushing the pressing roller 28, the door cover 21 is locked (held) in the fully closed state. According to the configuration described above, the second print mechanism 5 achieves a printing-enabled state, in which the platen 23 opposes the print head 14 in close proximity and the cutter 26 is set at the cutting position.

Figure 15:
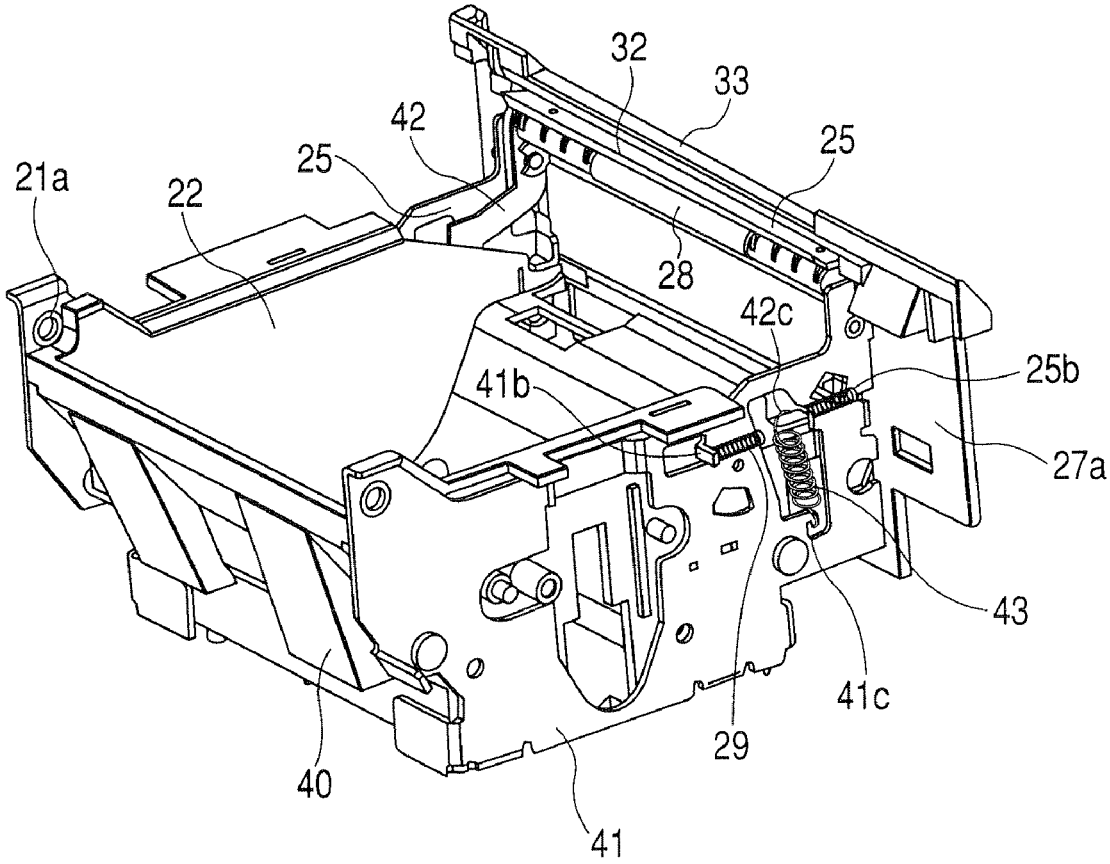
FIG. 15 is a perspective view of an assembled state of the supporting mechanism of FIG. 14.

When the door cover 21 is opened, the lock is released by lifting up the door cover 21 by hand, because the pressing roller 28 moves in a direction indicated by arrow J against the pushing force of the spring 43 (see FIG. 15). Motions of the respective members thereafter are opposite to those while the door cover 21 is being closed. As the boss 23*a* moves upward away from the vertical sliding face 31*b* and along the slanted sliding faces 31*a*, the arm 25 starts to pivot about the pivot center 25*a* in a direction indicated by arrow E by the pushing force of the tensile spring 29, and the cutter 26 thereby moves from the cutting position to the storing position. When the door cover 21 is further opened, and the bosses 23*a* are no longer in contact with the seat 25*c*, the cutter 26 is held again at the storing position. After then, the door cover 21 is opened such that the paper feeding roller 24 and the pressing roller 28 are largely separated from each other.

As described the above, when the door cover 21 is closed, the cutter 26 appears from the cutter cover 27 to move to the cutting position, after the paper feeding roller 24 and the pressing roller 28 are brought into contact with each other. On the other hand, when the door cover 21 is opened, the cutter 26 moves to the storing position to be covered by the cutter cover 27, before the paper feeding roller 24 and the pressing roller 28 are largely separated from each other. This reliably prevents the cutter 26 from being damaged. Further, since the user cannot see the cutter 26 during the opening or closing operation of the door cover 21, the appearance impression of the product can be improved.

Next, a printer according to a second embodiment of the invention will be described below with reference to FIGS. 10 and 11. Elements similar to those in the first embodiment will be designated by the same reference numerals and repetitive explanations for those will be omitted.

The second embodiment is different from the first embodiment in shape of a cutter 32 and a cutter cover 33 provided in the second print mechanism 5. In the first embodiment, the cutter 26 has a linear shape extending from the fixed end thereof to the cutting edge thereof. In the second embodiment, the cutter 32 is bent at an obtuse angle somewhere in the intermediate portion between the fixed end and the cutting edge. As is shown in FIG. 10, when the door cover 21 is not closed, the cutter 32 is placed at the retracted position at which the side face of the cutting edge of the cutter 32 abuts an inner wall 33*a* of the cutter cover 33. On the contrary, as is shown in FIG. 11, while the door cover 21 remains closed, the cutter 32 is placed at the cutting position at which the tip end thereof is spaced apart from the inner wall 33*a* of the cutter cover 33.

Motions of the respective members constituting the second print mechanism 5 while the fully-opened door cover 21 is being closed will be described. As is shown in FIG. 10, the tip end of the door cover 21 comes in close proximity to the pressing roller 28 as the fully-opened door cover 21 is closed. In this instance, as with the first embodiment, because the platen 23 is folded toward the inner face of the door cover 21, the platen 23 never interferes with the pressing roller 28. As the door cover 21 is closed further, the bosses 23*a* at both ends of the platen 23 come in contact with points on the slanted sliding face 31*a* indicated by arrow G, after which the bosses 23*a* move toward the print head 14 along the slanted sliding face 31*a*. The platen 23 thus moves in a direction indicated by arrow H, that is, to the position at which the platen 23 opposes the print head 14 in close proximity, against the pushing force of the spring 29.

Because the seat 25*c* at the bottom of the arm 25 is pressed by the bosses 23*a*, the arm 25 starts to pivot about the pivot center 25*a* in a direction indicated by arrow I. The cutter 32 thus moves to the cutting position, which is spaced apart by a predetermined distance from the retracted position at which the cutter 32 abuts on the inner wall 33*a* of the cutter cover 33. Also, the bosses 23*a* move onto the vertical sliding face 31*b* from the slanted sliding face 31*a*.

Figure 11:
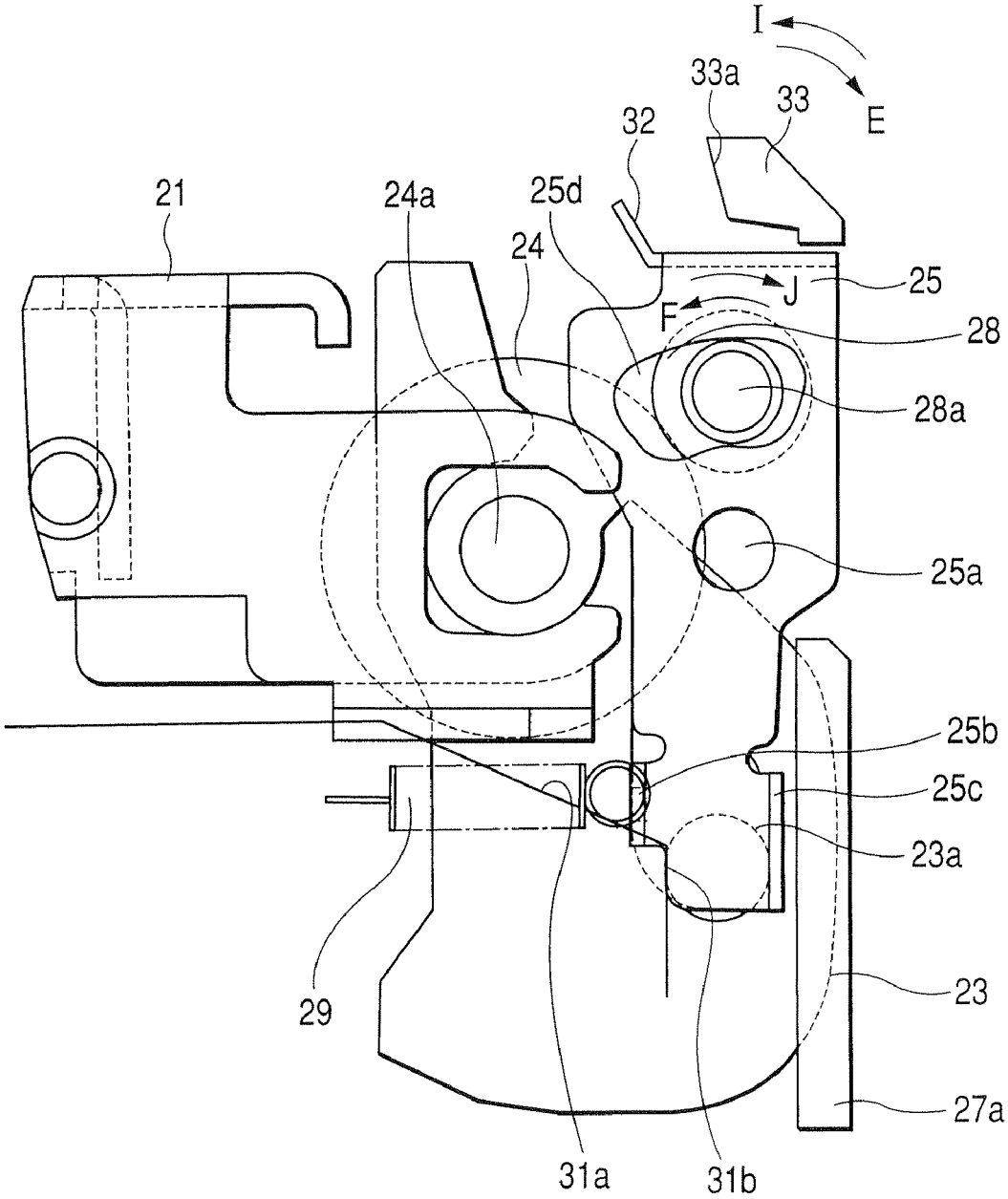
FIG. 11 is an enlarged side view of the tip end portion of the door cover in the printer of FIG. 10, showing the door cover fully closed.

Subsequently, the door cover 21 of the second print mechanism 5 is fully closed as shown in FIG. 11. The bosses 23*a* that have moved as described above are brought into engagement with the vertical sliding face 31*b*, which causes the platen 23 to be set almost perpendicular to the door cover 21 at the position at which the platen 23 opposes the print head 14 in close proximity. Because the arm 25 pivots to the vertical position as the seat 25*c* is pressed by the bosses 23*a*, the cutter 32 is set at the cutting position at the sheet outlet 30.

Also, because the paper feeding roller 24 provided at the tip end of the door cover 21 is pressed diagonally above by the pushing force of the pressing roller 28, the door cover 21 is locked in the fully closed state. The platen 23 is therefore set at the position opposing the print head 14 in close proximity, and the cutter 32 is set at the cutting position. A printing-enabled state for the second print mechanism 5 is thus achieved.

The lock of the door cover 21 is released when the door cover 21 is opened by lifting the door cover 21 upward, because the pressing roller 28 moves in a direction indicated by arrow J. Thereafter, the respective members move in the same manner as when the door cover 21 is being closed. When the door cover 21 is opened, the bosses 23*a* are no longer in contact with the seat 25*c*. The arm 25 thus starts to pivot in a direction indicated by arrow E by the pushing force of the tensile spring 29, which causes the cutter 32 to be held again at the retracted position at which the cutter 32 abuts on the inner wall 33*a* of the cutter cover 33.

According to the cutter mechanism in the second embodiment as described above, the side face angle of the cutting edge of the cutter 32 is set to maximize sharpness when the cutter 32 is at the cutting position while the door cover 21 remains closed. While the door cover 21 is open, the side face of the cutting edge of the cutter 32 abuts the inner wall 33*a* of the cutter cover 33, which causes the cutter 32 and the cutter cover 33 to be placed integrally, thereby saving space in the printer 100.

Next, a printer according to a third embodiment of the invention will be described below with reference to FIGS. 12 and 13. Elements similar to those in the second embodiment will be designated by the same reference numerals and repetitive explanations for those will be omitted. This embodiment is characterized by the combination of the cutter storing mechanism in the first embodiment and the cutter shape in the second embodiment.

Specifically, a cutter 34 is bent at an obtuse angle somewhere in the intermediate portion between the fixed end and the cutting edge as in the second embodiment. As is apparent from FIG. 12, the side face of the cutting edge of the cutter 34 does not abut an inner wall 35*b* of a cutter cover 35 when the door cover 21 is not closed. Instead, the cutting edge of the cutter 34 is placed at a storing position at which the cutting edge of the cutter 34 is covered by the inner wall 35*a* of the cutter cover 35.

In this embodiment, motions of the respective members while the fully-opened door cover 21 is being closed are the same as those in the first embodiment. Hence, the platen 23 and the pressing roller 28 do not interfere with each other, and the bosses 23*a* at both ends of the platen 23 come in contact with points on the slanted sliding face 31*a* indicated by arrow G, after which the bosses 23*a* move toward the print head 14 along the slanted sliding face 31*a*. The platen 23 thereby starts to move in a direction indicated by arrow H, that is, to the position at which the platen 23 opposes the print head 14 in close proximity, against the pushing force of the spring 29.

Figure 10:
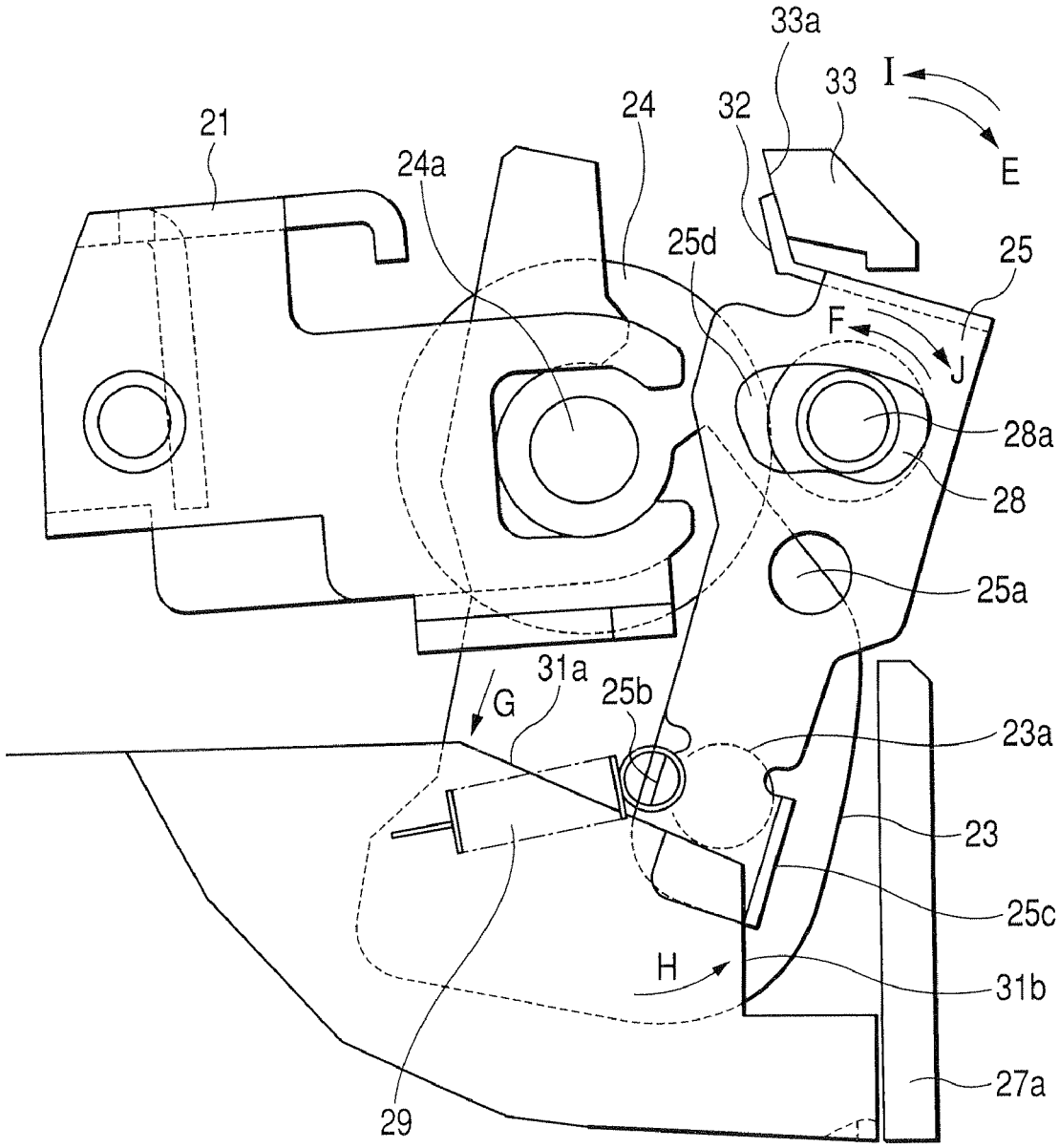
FIG. 10 is an enlarged side view of a tip end portion of a door cover in a printer according to a second embodiment of the invention, showing the door cover operated to be closed.
Figure 12:
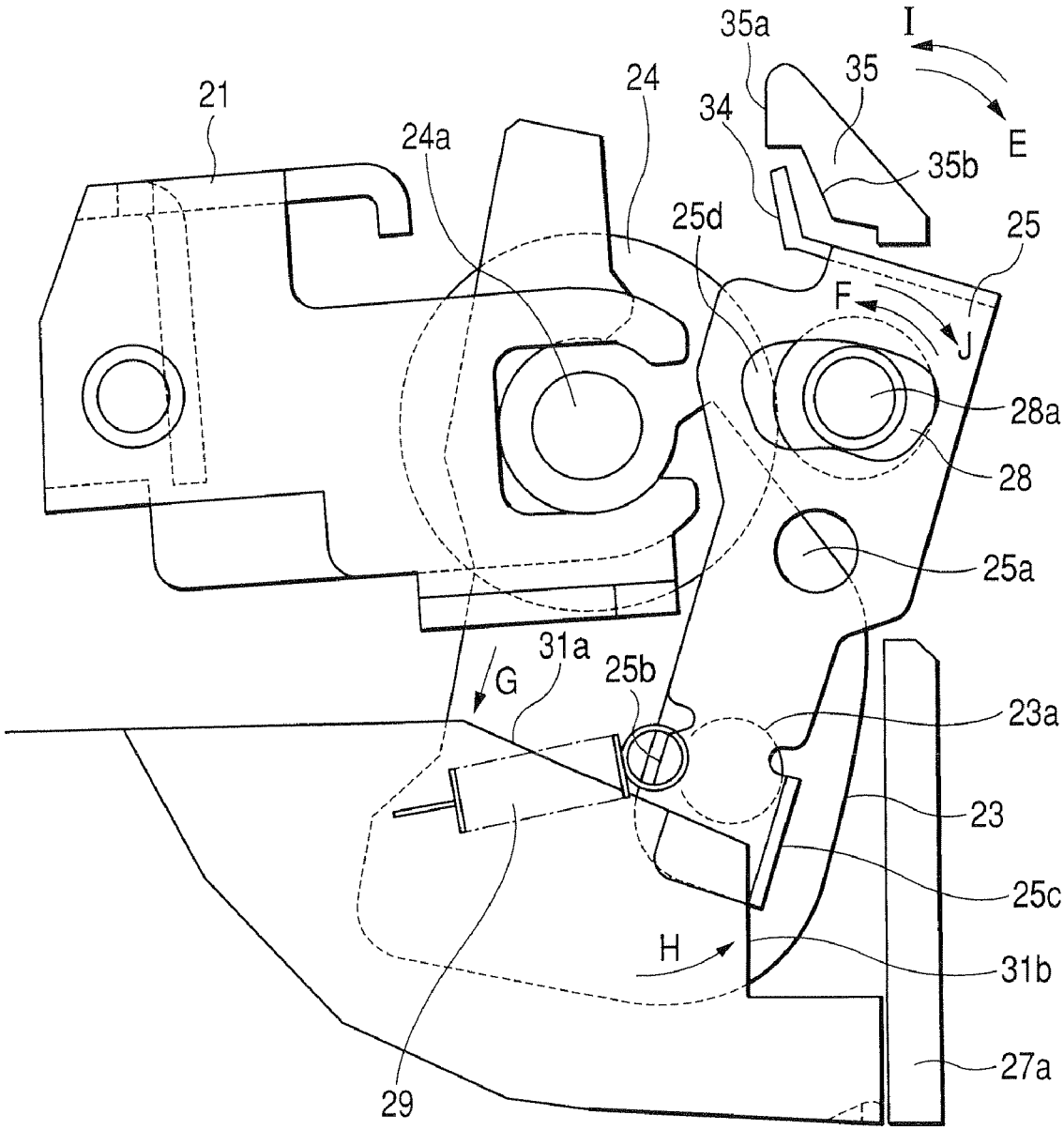
FIG. 12 is an enlarged side view of a tip end portion of a door cover in a printer according to a third embodiment of the invention, showing the door cover operated to be closed.

Referring to FIG. 12, the states of the paper feeding roller 24 and the pressing roller 28 in motions while the door cover 21 is being closed are the same as those shown in FIG. 10. That is to say, the seat 25*c* at the bottom of the arm 25 is pressed by the bosses 23*a*, and the arm 25 starts to pivot about the pivot center 25*a* in a direction indicated by arrow I. This causes the cutter 34 to move to the cutting position, which is spaced apart by a predetermined distance from the storing position at which the cutter 34 is covered by the cutter cover 35. The bosses 23*a* move onto the vertical sliding face 31*b* from the slanted sliding face 31*a*.

Figure 13:
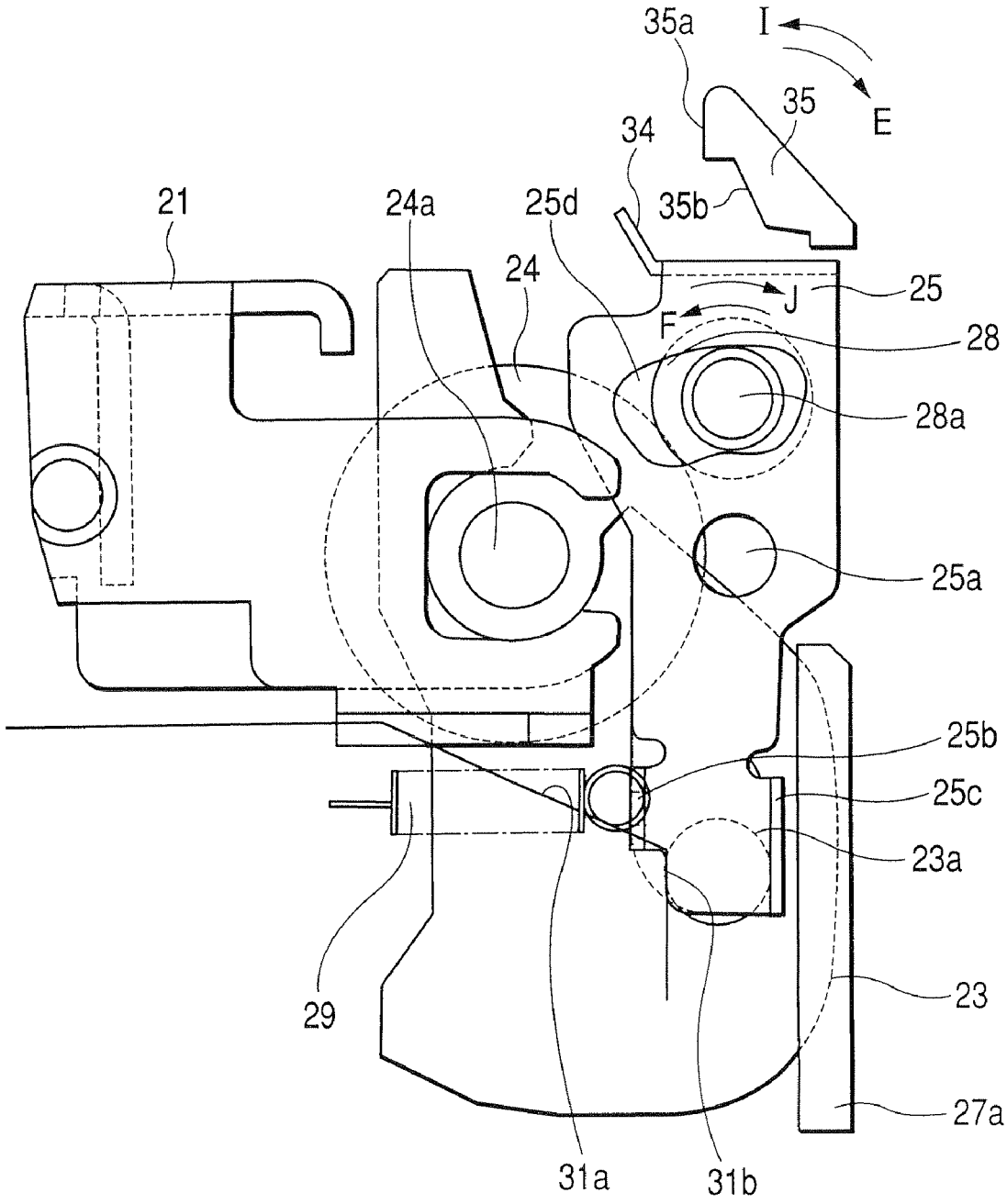
FIG. 13 is an enlarged side view of the tip end portion of the door cover in the printer of FIG. 10, showing the door cover fully closed.

The door cover 21 of the second print mechanism 5 is shown fully closed in FIG. 13. Incidentally, the position at which the platen 23 is set is the same as that shown in FIG. 11. To be more specific, the cutter 34 is set at the cutting position at the sheet outlet 30 and the platen 23 is set at the position at which the platen 23 opposes the print head 14 in close proximity. A printing-enabled state for the second print mechanism 5 is thus achieved.

Further, when the closed door cover 21 is opened, the respective members move in the manner as described above, which causes the arm 25 to rotate in a direction indicated by arrow E. The cutter 34 is thus held again at the storing position at which the cutter 34 is covered by the cutter cover 35.

According to the cutter mechanism in the third embodiment, the cutting edge is bent at an angle to maximize sharpness with respect to paper when the door cover 21 is closed. Further, the cutter cover 35 in the modification of the second embodiment is of a shape corresponding to the angle of the bent portion of the cutting edge of the cutter 34. By making the cutter cover 35 into a shape corresponding to the angle of the bent portion of the cutting edge of the cutter 34 at the storing position in this manner, that is, by making the inner wall 35*a* of the cutter cover 35 almost parallel to the bent portion of the cutting edge of the cutter 34, it is possible to store the cutter 34 in a narrow space, thereby saving space in the printer 100.

In this embodiment, when the cutter 34 is placed at the storing position, the side face of the cutting edge of the cutter 34 does not abut the inner wall 35*a* of the cutter cover 35. However, as in the second embodiment, the side face of the cutting edge of the cutter 34 may abut the inner wall 35*a* of the cutter cover 35. To be more specific, when the cutter 34 is placed at the storing position, the cutting edge of the cutter 34 is covered by the cutter cover 35 while the side face of the cutting edge of the cutter 34 is allowed to abut part of the inner wall 35*a* of the cutter cover 35.

The attachment structure of the arm 25 and the pressing roller 28 of the second print mechanism 5 will now be described with reference to FIGS. 14 and 15. This attachment structure is applicable to all the above embodiments. The attachment structure for the second embodiment will be exemplified here.

Figure 14:
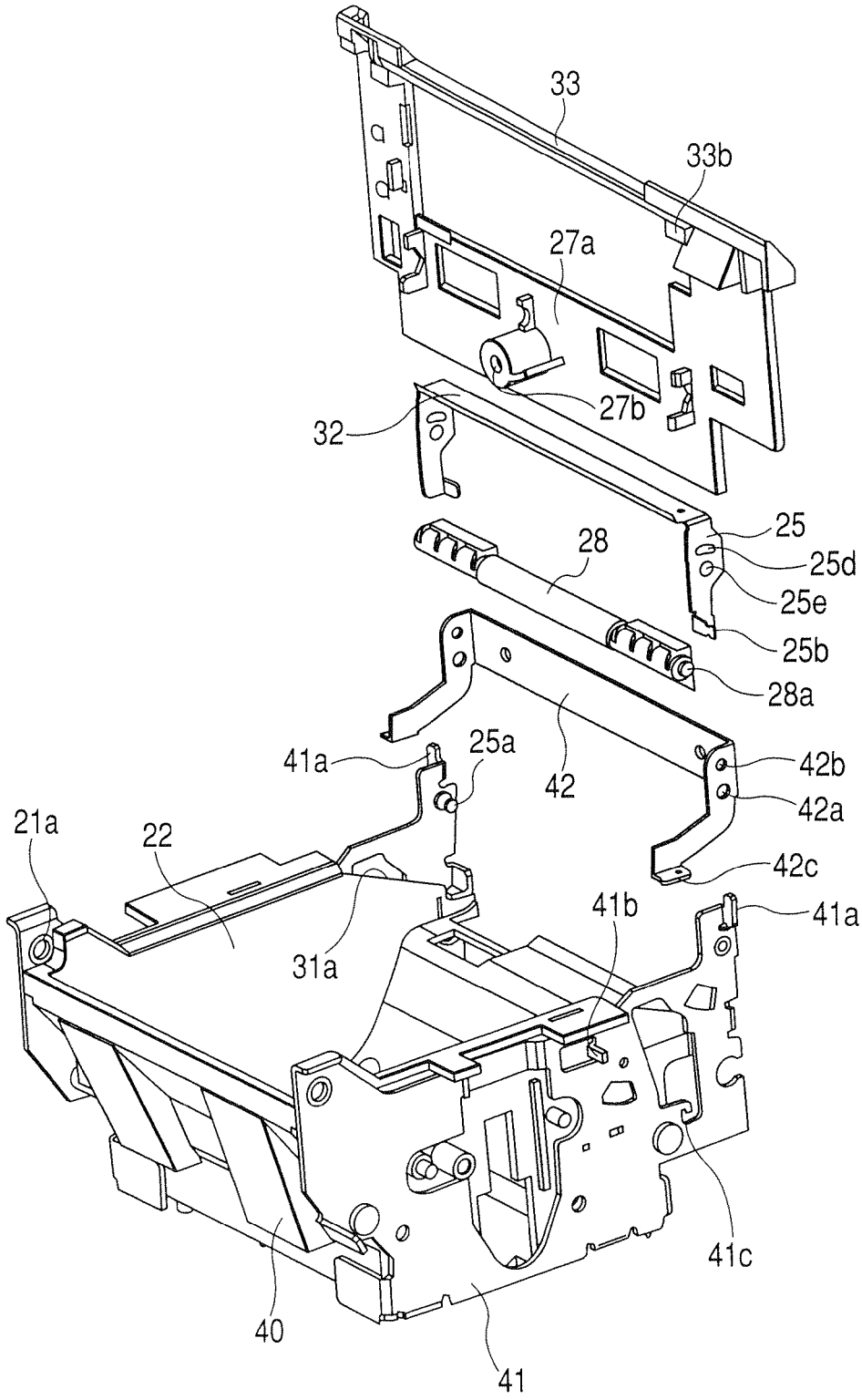
FIG. 14 is a perspective view of a disassembled state of a supporting mechanism for a cutter in the printer of the second embodiment.

In FIGS. 14 and 15, a holder 40, a frame 41, and the roller arm 42 are shown in addition to the aforementioned members, such as the accommodating section 22, the arm 25, the pressing roller 28, the cutter 32, the cutter cover 33, etc.

As is shown in FIG. 14, the holder 40 provided beneath the accommodating section 22 is supported by the frame 41 serving as a framework. The paper guide 27*a* and the pivot center 25*a* are provided in the front face of the frame 41. The arm 25 is attached to the pivot center 25*a* via holes 25*e*, and the roller arm 42 is also attached to the pivot center 25*a* via holes 42*a*. Meanwhile, the pressing roller 28 is attached to roller bearings 42*b* provided to the roller arm 42, in a rotatable manner via the roller shaft 28*a*. As has been described, the arm 25 provided with the cutter 32 and the roller arm 42 to which the pressing roller 28 is attached are configured to be able to turn independently with respect to the pivot center 25*a*.

The paper guide 27*a* formed integrally with the cutter cover 33 is provided with a screw hole 27*b* at the bottom, and is thereby fastened to the bottom of the holder 40 with a screw. It is configured such that a pair of concave portions 33*b*, each being recessed at the bottom, is formed at the end portions of the cutter cover 33, and a pair of protrusions 41*a* formed on the frame 41 engages with the pair of concave portions 33*b*. When the frame 41 and the cutter cover 33 are combined into one unit and the door cover 21 is closed as it pivots about the pivot center 21*a* of the frame 41 in this manner, the print face of the platen 23 is placed in the opening below the cutter cover 33.

The frame 41 is provided with a bracket 41*b* and a bracket 41*c*. As is shown in FIG. 15, the tensile spring 29 described above that keeps pushing the arm 25 is attached between the bracket 41*b* of the frame 41 and the bracket 25*b* of the arm 25. The tensile spring 29 produces a force that presses the arm 25 toward the cutter cover 33 (in the direction indicated by arrow E in FIGS. 9 and 10). Also, the spring 43 that keeps pushing the roller arm 42 is attached between the bracket 41*c* of the frame 41 and the bracket 42*c* of the roller arm 42. The spring 43 produces a force that presses the pressing roller 28 toward the paper feeding roller 24 as described above.

In the respective embodiments described above, the movable platen is combined with the cutter mechanism. However, the printer may be provided with the cutter mechanism alone.

In the embodiments described above, a manual cutter is described; however, the cutter mechanism may include the stationary blade of an automatic cutter.

In addition, the respective embodiments form part of a printer having a U-shaped transportation path; however, an alternative printer without a U-shaped transportation path may be provided.

In the respective embodiments described above, when the door cover 21 is opened, the door cover 21 is lifted up by hand. A press button may alternatively be provided on the side of the accommodating section 22, so that the door cover 21 is moved upward from the bottom by a ladder-shaped lever when the press button is depressed.

In the respective embodiments described above, the pressing roller 28 is attached to the roller arm 42 in a rotatable manner; however, the axis 28*a* of the pressing roller 28 may be attached slidably to the fan-shaped holes 25*d* in the arm 25, and a spring that keeps pushing the pressing roller 28 toward the paper feeding roller 24 may be provided. In this case, the roller arm 42 to support the pressing roller 28 can be omitted.

In the respective embodiments described above, the door cover 21 supports the paper feeding roller 24; however, the door cover 21 may support the pressing roller 28 while the paper feeding roller 24 may be supported by the printer body.

In the respective embodiments described the above, the cutter 26 is moved to the storing position before the paper feeding roller 24 and the pressing roller 28 are largely separated; however, the cutter 26 may be stored in the cutter cover 27 until the opening formed by opening the door cover 21 becomes about 1 cm. Also in such a case, the damage of the cutter 26 can be avoided.

In the respective embodiments described the above, the arm 25 provided with the cutter 26 is pivoted by the boss 23*a* of the platen 23 which is pivotably supported on the door cover 21; however, the arm 25 may be directly pivoted by the door cover 21.

In the respective embodiments described the above, the pivot center (shaft member) 25*a* is formed on the frame 41 and fitted into the hole 25*e* of the arm 25; however, the shaft member may be formed on the arm 25 while the frame 41 may be formed with a hole into which the shaft member is fitted.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A printer, comprising:

a holder having an accommodating section adapted to accommodate a rolled sheet, the holder including a sliding face;

a cover movable between an open position for opening the accommodating section and a closed position for covering the accommodating section;

a first roller operable to feed a part of the rolled sheet fed from the accommodating section when the cover is placed in the closed position;

a print head operable to perform printing on the part of the rolled sheet;

a cutter movable between an operable position at which the cutter is operable to cut the part of the rolled sheet and a covered position at which the cutter is not operable to cut the part of the rolled sheet, the cutter being moved to the operable position when the cover is moved from the open position to the closed position;

a pivotable arm member supporting the cutter;

a platen member having a platen face and a boss, the platen member being coupled to the cover and movable between a facing position at which the platen face opposes the print head and a retracted position; and a cutter cover which covers the cutter when the cutter is placed in the covered position, wherein:

the platen member is moved to the facing position when the cover is moved from the open position to the closed position, and is moved to the retracted position when the cover is moved from the closed position to the open position, and the boss is positioned relative to the holder and the arm member such that the boss is configured to move along the sliding face of the holder and come in contact with the arm member when the platen member is moved to the facing position, thereby pivoting the arm member to move the cutter toward the operable position.

2. The printer as set forth in claim 1, wherein the cutter is bent such that a cutting edge thereof is covered by the cutter cover when the cutter is placed in the covered position.

3. The printer as set forth in claim 1, further comprising an elastic member which urges the arm member so that the cutter is moved from the operable position to the covered position when the cover is moved from the closed position to the open position, wherein the cover is brought into contact with the arm member to pivot the arm member so that the cutter is moved from the covered position to the operable position against an urging force of the elastic member when the cover is moved from the open position to the closed position.

4. The printer as set forth in claim 1, wherein:

the first roller is provided on the cover; and the printer further comprises:

a second roller disposed so as to oppose the first roller when the cover is placed in the closed position; and an elastic member urging the second roller against the first roller to nip the part of the rolled sheet therebetween and to retain the cover in the closed position.

5. The printer as set forth in claim 1, wherein:

the boss includes bosses provided on both sides of the platen member;

the sliding face includes slanted sliding faces and vertical sliding faces; and the bosses are configured to move along the slanted sliding faces of the holder and engage with the vertical sliding face, when the platen member is placed in the facing position and the cutter is placed in the operable position.

6. A printer, comprising:

a holder having an accommodating section adapted to accommodate a rolled sheet, the holder including a sliding face;

a cover movable between an open position for opening the accommodating section and a closed position for covering the accommodating section;

a first roller operable to feed a part of the rolled sheet fed from the accommodating section when the cover is placed in the closed position;

a print head operable to perform printing on the part of the rolled sheet;

a cutter movable between an operable position at which the cutter is operable to cut the part of the rolled sheet and a retracted position at which the cutter is not operable to cut the part of the rolled sheet, the cutter being moved to the operable position when the cover is moved from the open position to the closed position;

a pivotable arm member supporting the cutter;

a platen member having a platen face and a boss, the platen member being coupled to the cover and movable between a facing position at which the platen face opposes the print head and a retracted position; and a cutter cover having a face onto which a cutting edge of the cutter is brought into contact when the cutter is placed in the retracted position, wherein:

the platen member is moved to the facing position when the cover is moved from the open position to the closed position, and is moved to the retracted position when the cover is moved from the closed position to the open position, and the boss is positioned relative to the holder and the arm member such that the boss is configured to move along the sliding face of the holder and come in contact with the arm member when the platen member is moved to the facing position, thereby pivoting the arm member to move the cutter toward the operable position.

7. The printer as set forth in claim 6, wherein the cutter is bent with such an angle that at least the cutting edge is brought into contact with the face of the cutter cover when the cutter is placed in the retracted position.

8. The printer as set forth in claim 6, further comprising an elastic member which urges the arm member so that the cutter is moved from the operable position to the inoperable position when the cover is moved from the closed position to the open position, wherein the cover is brought into contact with the arm member to pivot the arm member so that the cutter is moved from the inoperable position to the operable position against an urging force of the elastic member when the cover is moved from the open position to the closed position.

9. The printer as set forth in claim 6, wherein:

the first roller is provided on the cover; and the printer further comprises:

a second roller disposed so as to oppose the first roller when the cover is placed in the closed position; and an elastic member urging the second roller against the first roller to nip the part of the rolled sheet therebetween and to retain the cover in the closed position.

10. The printer as set forth in claim 6, wherein:

the boss includes bosses provided on both sides of the platen member;

the sliding face includes slanted sliding faces and vertical sliding faces; and the bosses are configured to move along the slanted sliding faces of the holder and engage with the vertical siding face, when the platen member is placed in the facing position and the cutter is placed in the operable position.

* * * * *